US009975620B2

(12) United States Patent
Sprague

(10) Patent No.: US 9,975,620 B2
(45) Date of Patent: May 22, 2018

(54) BOW AND STERN THRUSTER AND RELATED METHODS

(71) Applicant: DockStar LLC, Hansville, WA (US)

(72) Inventor: Randall Brian Sprague, Hansville, WA (US)

(73) Assignee: DockStar LLC, Hansville, WA (US)

( * ) Notice: Subject to any disclaimer, the term of this patent is extended or adjusted under 35 U.S.C. 154(b) by 0 days. days.

(21) Appl. No.: 15/274,691

(22) Filed: Sep. 23, 2016

(65) Prior Publication Data

US 2017/0120998 A1 May 4, 2017

Related U.S. Application Data

(60) Provisional application No. 62/248,876, filed on Oct. 30, 2015.

(51) Int. Cl.

| | |
|---|---|
| ***B63H 21/17*** | (2006.01) |
| ***B60L 11/00*** | (2006.01) |
| ***B63H 25/42*** | (2006.01) |
| ***B63H 20/06*** | (2006.01) |
| ***B63H 20/10*** | (2006.01) |

(52) U.S. Cl.

CPC ..... *B63H 25/42* (2013.01); *B63H 20/06* (2013.01); *B63H 20/10* (2013.01); *B63H 2025/425* (2013.01)

(58) Field of Classification Search

CPC ..... B63H 5/07; B63H 5/125; B63H 5/1252; B63H 5/18; B63H 5/20; B63H 21/17; B63H 2005/005; B63H 2005/07; B63H 2005/125

USPC ..... 440/6, 53, 55, 63, 79

See application file for complete search history.

(56) References Cited

U.S. PATENT DOCUMENTS

| | | | | |
|---|---|---|---|---|
| 3,315,631 A * | 4/1967 | Bass | B63H 20/007 440/6 |
| 6,054,831 A * | 4/2000 | Moore | B63H 20/007 114/144 R |
| 2007/0232157 A1* | 10/2007 | Lee | B63H 20/007 440/6 |
| 2010/0116967 A1* | 5/2010 | Todd | B63H 20/007 248/642 |

* cited by examiner

*Primary Examiner* — Daniel V Venne

(74) *Attorney, Agent, or Firm* — Viksnins Harris Padys Malen LLP

(57) ABSTRACT

A bow and stern thruster apparatus includes a motor, a propeller, a battery, a radio receiver, control logic, and power driver circuitry; together forming a fully integrated thruster unit that slides up and down along a guide device to a hull attachment fixture near the water line of a boat. The deployed thruster unit can act as a bow or a stern thruster depending on where the guide device and attachment fixture are mounted to the boat. The thruster unit is retracted by raising it along the guide device to be stowed well above the water line, or to be removed entirely from the hull.

18 Claims, 13 Drawing Sheets

BOW AND STERN THRUSTER AND RELATED METHODS

CROSS-REFERENCE TO RELATED APPLICATION

This patent application claims priority of U.S. Provisional Application No. 62/248,876 that was filed on Oct. 30, 2015. The entire content of the application referenced above is hereby incorporated by reference herein.

TECHNICAL FIELD

The subject matter is related to bow and stern thrusters for recreational boaters.

TECHNICAL BACKGROUND

Bow and stern thrusters are a common piece of equipment on many boats. They provide the necessary thrust to change the yaw direction of a boat in tight quarters. In many instances the presence of wind or current in a tight marina makes safe handling of some boats nearly impossible without a thruster.

However, conventional thrusters come at a price. They are expensive to purchase and very expensive to install. Typically, the boat hull most be modified to add a "tunnel" through the boat where the thruster propeller is located and the thrusted water flows. Power must be routed to the thruster to provide the high current requirements. Finally, control devices and wiring must be installed from the helm to the bow thruster. Since much of this work is below the water line, the boat must be hauled out of the water.

The tunnel and thruster components add to the hydraulic drag of the boat. To reduce this drag the hulls are often further modified to fair the hull leading into the tunnel opening.

The resulting configuration creates new opportunities for hull leaks and exposes the thruster components to corrosion, fouling from marine life, and catching seaweed and other floating debris. Since the thruster components are underwater and inaccessible they are difficult to clean and maintain without hauling the boat out of the water periodically.

There are existing alternatives to the common tunnel thruster just described. These alternatives address the key issue of having to cut holes in the hull of the boat for the tunnel, but not the other issues. Further, they create additional problems.

One alternative is to mount a "pod" to the bottom of the keel. This pod has a small tunnel through it with a propeller in the tunnel. This eliminates the need for cutting holes in the hull of the boat for placing a thruster tunnel, although it is usually required to modify the hull to fair the pod with the hull. The boat must still be hauled out of the water to drill the mounting holes for the pod, and run the power and control wires through the hull. Furthermore, the thruster is still subject to corrosion and fouling and must be hauled out periodically for cleaning. Importantly, the pod creates more drag than the traditional tunnel approach and renders the thruster vulnerable to damage from strikes from floating debris (such as logs) or from groundings.

A second alternative is to bolt a thruster unit to the front of the bow below the water line. This also eliminates the need for cutting holes in the hull of the boat for placing a thruster tunnel, but it does not address the other issues raised. The boat still needs to be hauled out of the water to drill the underwater mounting holes and to run the power and control cables. This second alternative is not very popular due to the sizeable drag created by its externally bolted structure, and the vulnerability to damage from floating debris, ground strikes, and trailering.

As useful as bow and stern thrusters are, the negatives prevent many boat owners from outfitting them on their boats. This is particularly true of sailboat owners who cannot afford the increased drag created by conventional bow thrusters.

SUMMARY

In one or more embodiments, a thruster apparatus for use with a boat at either the stern or bow is described herein. The thruster apparatus includes one or more electric motors operatively coupled with one or more propulsion devices, the one or more electric motors configured to drive one or more propulsion devices. The apparatus further includes at least one power source coupled with the electric motors, the at least one power source configured to provide power for the one or more electric motors. An electrical controller is configured to receive a wireless signal, the controller configured to control power to the electric motors based on the signal. A thruster unit housing is provided with the apparatus and contains the one or more motors with propulsion devices, electrical controller, and the at least one power source. The apparatus further includes a sliding car coupled with the thruster unit housing, one or more hull attachment fixtures mounted to the hull of the boat with at least one hull attachment fixture mounted near a water line, and a guide device coupled with one or more hull attachment fixtures, the guide device configured to guide the sliding car up and down.

In one or more embodiments, the guide device is a track.

In one or more embodiments, the thruster unit housing and sliding car mechanism can be removed from the track once the thruster unit housing is raised to a deck allowing for the removal of the thruster unit housing from the hull of the boat.

In one or more embodiments, the guide device is a guy line and at least one of the one or more hull attachment fixtures has a guide rail that engages with the sliding car as the sliding car slides down along the guy line.

In one or more embodiments, the thruster unit housing and sliding car are removably coupled with the guy line.

In one or more embodiments, the thruster unit housing and the sliding car are coupled together into a single assembly.

In one or more embodiments, wherein the at least one power source includes one or more batteries.

In one or more embodiments, a thruster apparatus for use with a boat is described herein. The thruster apparatus includes one or more electric motors operatively coupled with one or more propulsion devices, the one or more electric motors configured to drive one or more propulsion devices. The apparatus further includes at least one power source coupled with the electric motors, the at least one power source configured to provide power for the one or more electric motors. An electrical controller is configured to receive a wireless signal, the controller configured to control power to the electric motors based on the signal. A thruster unit housing is provided with the apparatus and contains the one or more motors with propulsion devices, electrical controller, and the at least one power source. The apparatus further includes a means for guiding the thruster unit housing up and down a hull of the boat.

In one or more embodiments, the means for guiding the thruster unit housing includes a sliding car coupled with the thruster unit housing, the sliding car slideably coupled with a guide device mounted on the hull.

In one or more embodiments, the guide device is a track.

In one or more embodiments, the thruster unit housing and sliding car mechanism can be removed from the track once the thruster unit housing is raised to a deck allowing for the removal of the thruster unit from the hull of the boat.

In one or more embodiments, the guide device is a guy line and at least one of the one or more hull attachment fixtures has a guide rail that engages with the sliding car as it slides down along the guy line.

In one or more embodiments, the thruster unit housing and sliding car are removably coupled with the guy line.

In one or more embodiments, the thruster unit housing and the sliding car are coupled together into a single assembly.

In one or more embodiments, the at least one power source includes one or more batteries.

In one or more embodiments, a method for using a thruster apparatus with a boat is provided herein. The method includes providing power from at least one power source to one or more electric motors, sending a wireless signal from a transmitter to an electrical controller that receives the wireless signal and controls power to the one or more electric motors based on that signal, driving one or more propulsion devices with the one or more electric motors, where a thruster unit housing contains the one or more motors, the electrical controller, and the at least one power source. The method further includes sliding a sliding car along a guide device, where the sliding car is coupled with the thruster unit housing, and the guide device is coupled along a hull of the boat with one or more hull attachment fixtures.

In one or more embodiments, sliding the sliding car on the guide device includes sliding the sliding car on a track.

In one or more embodiments, the method further includes removing the thruster unit housing and sliding car mechanism from the track once the thruster unit housing is raised to the deck.

In one or more embodiments, the thruster unit housing and sliding car can be removed from the guy line once raised to the deck allowing for the removal of the thruster unit from the hull of the boat.

These and other embodiments, aspects, advantages, and features of the present invention will be set forth in part in the description which follows, and will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims and their equivalents.

BRIEF DESCRIPTION OF THE DRAWINGS

An understanding of the apparatus and methods will now be had upon reference to the following detailed description, when read in conjunction with the accompanying drawings, where like reference characters refer to like parts throughout the several views, and in which:

FIG. 3A shows the thruster unit in the fully deployed position. FIG. 3C shows the thruster in the fully retracted position. FIG. 3B shows the thruster unit somewhere in between fully deployed and fully retracted.

FIG. 5A shows the thruster unit in the fully deployed position. FIG. 5C shows the thruster in the fully retraced position. FIG. 5B shows the thruster unit somewhere in between fully deployed and fully retracted.

FIG. 7A shows the thruster unit in the fully deployed position. FIG. 7B shows the thruster in the fully retracted position.

DETAILED DESCRIPTION

Figure 1:
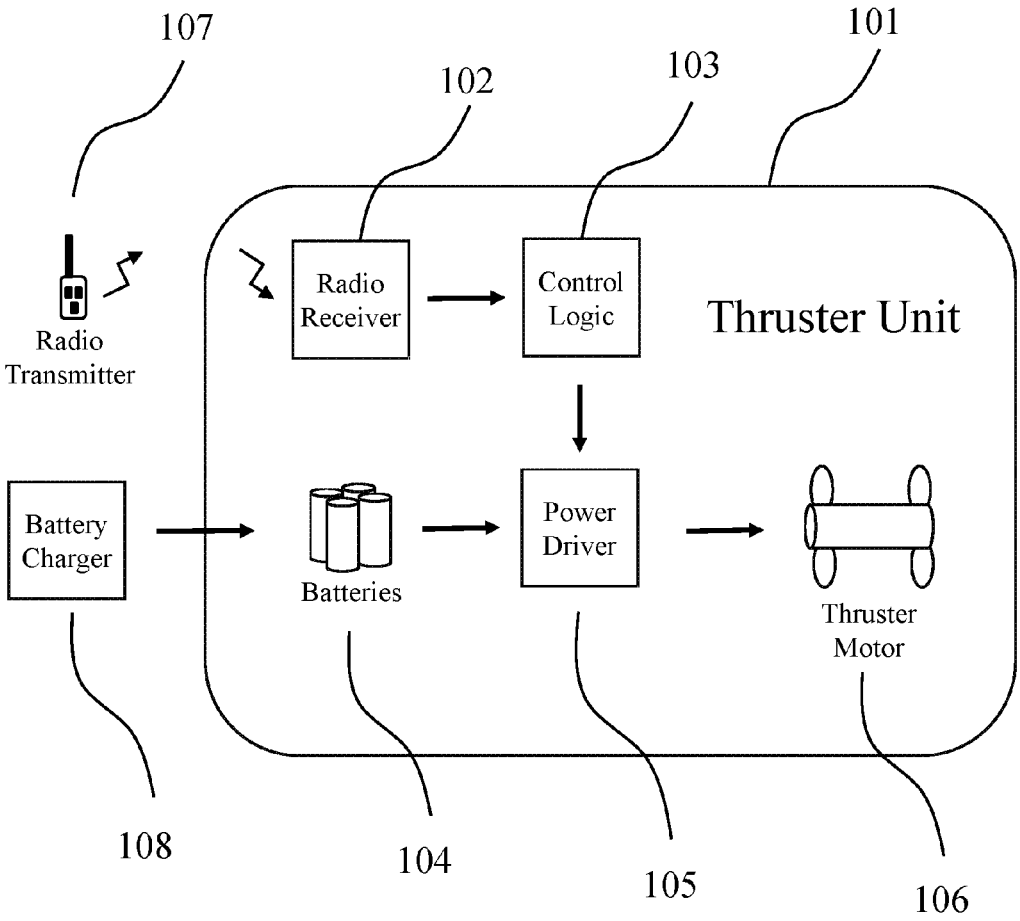
FIG. 1 shows a block diagram of an apparatus to receive directional commands from a transmitter, process those commands, and provide electrical current to a thruster motor.

The following detailed description includes references to the accompanying drawings, which form a part of the detailed description. The drawings show, by way of illustration, specific embodiments in which the apparatus may be practiced. These embodiments, which are also referred to herein as "examples" or "options," are described in enough detail to enable those skilled in the art to practice the present embodiments. The embodiments may be combined, other embodiments may be utilized or structural or logical changes may be made without departing from the scope of the invention. The following detailed description is, therefore, not to be taken in a limiting sense and the scope of the invention is defined by the appended claims and their legal equivalents.

In this document, the terms "a" or "an" are used to include one or more than one, and the term "or" is used to refer to a nonexclusive "or" unless otherwise indicated. In addition, it is to be understood that the phraseology or terminology employed herein, and not otherwise defined, is for the purpose of description only and not of limitation.

An electric bow or stern thruster system must have a motor with a means of propulsion, a source of electrical power, a means for control, and a means for attaching to the boat. The present invention integrates all of these functions of a bow or stern thruster into a self-contained unit. This allows for mounting schemes that provide for secure attachment to the boat while allowing for retraction of the thruster, or even removal from the hull for storage.

A bow or stern thruster requires a tremendous amount of power for a relatively short period of time. However, it is only used to control the boat during docking and undocking maneuvers. It sits idle while at dock and while underway. The present invention takes advantage of this low duty cycle, high discharge usage by employing modern high power (watts), low capacity (joules) batteries. Lithium Iron Phosphate (LiFePo) batteries, for example, exist that can provide 100 Amps of power yet are only 1.5 inches in diameter. Four of these batteries in series provide 12 volts, suitable for driving thruster motors. These batteries can provide sufficient power to drive one or more thruster motors for a period of 5 to 15 minutes. This is more than enough time to support an undocking and a subsequent docking maneuver before having to be recharged.

The present invention uses modern high power batteries that are compact enough to be integrated into the thruster unit housing along with one or more motors, along with electronic circuitry to receive the wireless command signals and process them to control the current flowing into the one or more motors. The invention also includes a means for activating the thruster unit and a means for recharging the batteries when not in use.

A key feature of the invention is the ability to deploy the thruster unit such that the one or more motors are sufficiently below the water line, and then to retract the thruster unit up out of the water. The thruster unit can even be removed completely from the hull since there are no electrical connections tethering it to the boat.

In one or more embodiments, a track is included that the thruster unit rides on. A tether line attached to the thruster unit can be pulled to retract the thruster unit or let out to deploy the unit. By sliding the thruster unit all the way off the top-side of the track the unit can be removed from the hull. A "T-track", for example, is a conventional piece of sailboat hardware that allows a car to slide along the T-track. The term "car" is borrowed from conventional sailboat hardware terminology and is used here to refer to a hardware component that slides along a track or a guy line. This form of mounting provides a very robust mounting scheme once the car is held fast on the track. Some embodiments of the invention use the weight of the thruster unit to hold the car securely at the bottom of the track while deployed, and use a tether line attached to the car or to the thruster unit to hold the car securely to the top of the track while retracted.

One or more embodiments include a guy line wire for the car to ride along. The guy line, for example, can be a wire, rope, or rod and is anchored to the bow of the boat near the water line and is further secured near the deck of the boat. The car rides up and down along this guy line by using a tether attached to the car or to the thruster unit. The car can be removed from the guy line by removing locking pins or other suitable attachment devices holding the car to the guy line.

In one or more embodiments the thruster unit can slide along the car itself. Thus, the car can be raised and lowered relative to the boat while the thruster unit can be further raised above the end of the track or guy line to increase the stowed position clearance to the sea. This is particularly useful in rough seas.

It should be understood that there are many variants to how the thruster unit gets deployed and retracted. For example, by providing slack to the guy line it would be possible to haul the thruster unit and/or car completely up onto the deck. Another variant would be to extend the track or guy line above the deck to allow retracting the thruster completely above the deck.

The term "thruster unit" is used to describe a mechanically sturdy apparatus consisting of a battery, a propulsion motor, a radio receiver, control logic, and power driver circuitry.

The term propulsion device is used to describe any number of means for converting electrical power into mechanical hydraulic thrust. This can be a propeller (203, 204), a pump, or a water jet for example.

The term "integrated" is used to describe an assemblage of parts in close proximity. This can be in one or more housings that are generally mechanically attached together.

The term "sliding car" or "car" is used to describe a mechanical device that slides along a track or guy line in substantially a linear motion. This mechanical device does not need to be a separate unit such that the sliding guide function of the "car" may be integrated into the thruster unit housing.

The term "guy line" is used to describe a generally straight mechanical device that can be a rope, a wire, a rod, a bar, or any similar structurally strong material.

The term "guide device" is used to describe a mechanical device such as a track 302, a bar, a rope, a wire, or a rod that guides the travel of a sliding car along a predominately linear path.

The term "hull attachment fixture" is used to describe a device for firmly attaching a guide device to the hull of a boat. This can be as simple as a bolt or could be more complicated to include alignment features. In some embodiments only one hull attachment fixture is used. In this case, the hull attachment fixture would be mounted near the water line of the hull. In other embodiments additional hull attachment fixtures are used. In this case, some of the hull attachment fixtures could be mounted on the hull near the deck of the boat.

The term "guide rail" is used to describe a mechanism for aligning the sliding car to a hull attachment fixture, and may be part of the hull attachment fixture. In some embodiments the guide device does not fully constrain the motion of the sliding car. A guy line, for example, does not constrain the car from rotating about the guy line. Nor does it prevent the car from torqueing the guy line to roll or pitch with respect to the hull. To constrain the motion of the car, with the exception of the freedom to move along the length of the guy line, a guide rail is used that engages with the car as it is lowered to the water line. The term "guide rail" is used broadly to include any mechanical means for engaging with the car and constraining its motion in all directions except along the length of the guide device.

Further detailed description of these and other embodiments is provided below.

FIG. 1 shows a block diagram of thruster unit 101. The thruster unit is an integrated collection of the key thruster components. Also shown in the block diagram are two components exterior to thruster unit 101. These are radio transmitter 107 and battery charger 108. A power source is provided. In one or more embodiments, battery charger 108 provides electrical current to batteries 104 when the thruster unit 101 is not deployed. Radio transmitter 107 is controlled by the operator to signal to the thruster unit to either thrust left, right, or off. Radio receiver 102 receives these signals and provides the left, right, or off commands to control logic 103. Control logic 103 employs algorithms to determine when power driver 105 should be directed to provide current into or out of thruster motor 106. These algorithms, for example, can use the present directional command information, historical directional command information, and battery condition information to determine the appropriate input to power driver 105. Based on this input, power driver 105 will cause thruster motor 106 to provide thrust to move the boat either to the left or to the right, or to turn the thruster motor 106 off. The collection of electrical control components radio receiver 102, control logic 103, and power driver 105 can be referred to as an "electrical controller".

Figure 2:
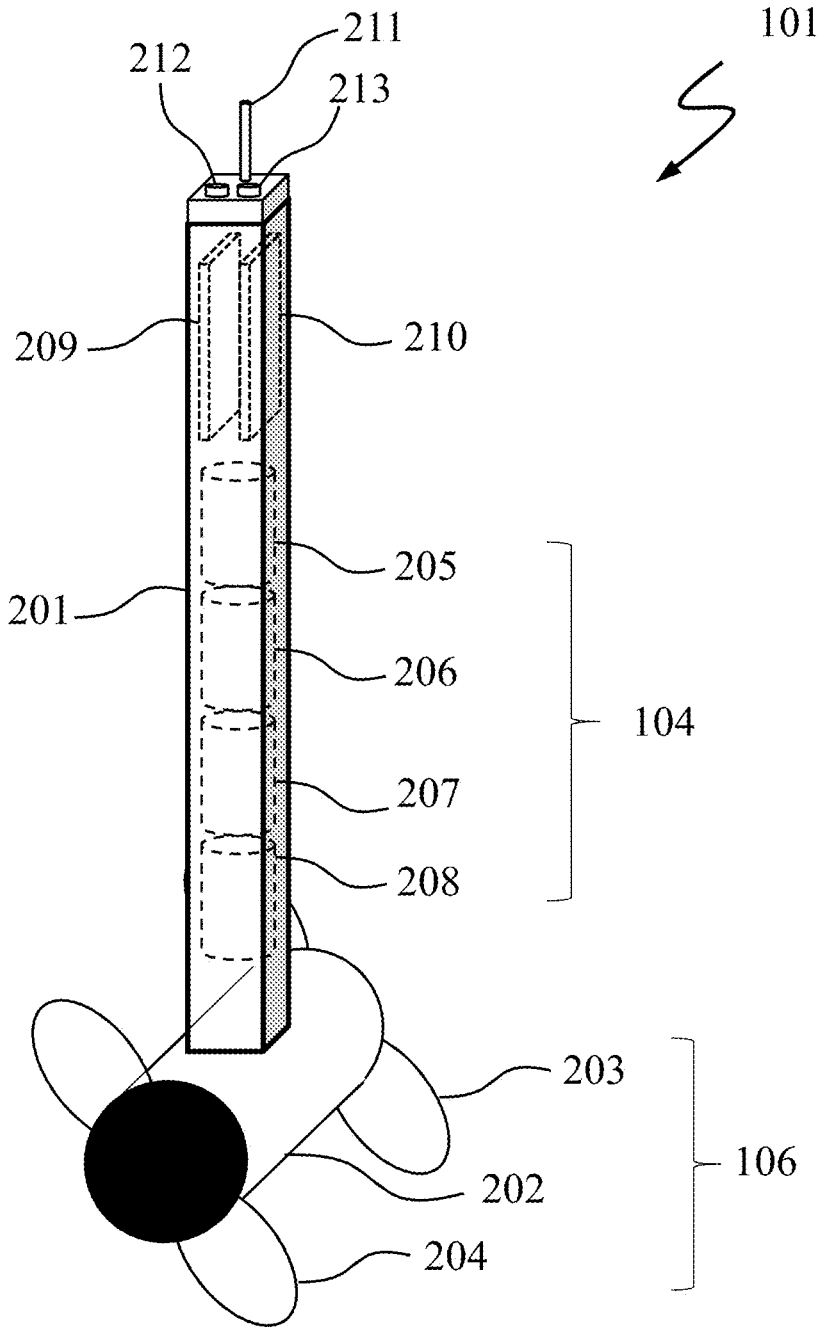
FIG. 2 shows one embodiment of a thruster unit and its components.

FIG. 2 shows one embodiment of thruster unit 101. Thruster unit housing 201 mounts to electrical motor 202. The rotating shaft of electrical motor 202 is connected to propellers 203 and 204. Components 202, 203, and 204 together form thruster motor 106. Batteries 205, 206, 207, and 208 are integrated inside thruster unit housing 201. Together, these form battery 104. The electrical controller components are attached to circuit boards 209 and 210 which are also integrated inside thruster unit housing 201. Radio signals are received by antennae 211. Battery charger connector 212 is mounted so as to be accessible to the outside of thruster unit housing 201. On/off switch 213 is also accessible to the outside of thruster unit housing 201 and is used to enable or disable thruster unit 101.

Figure 3A:
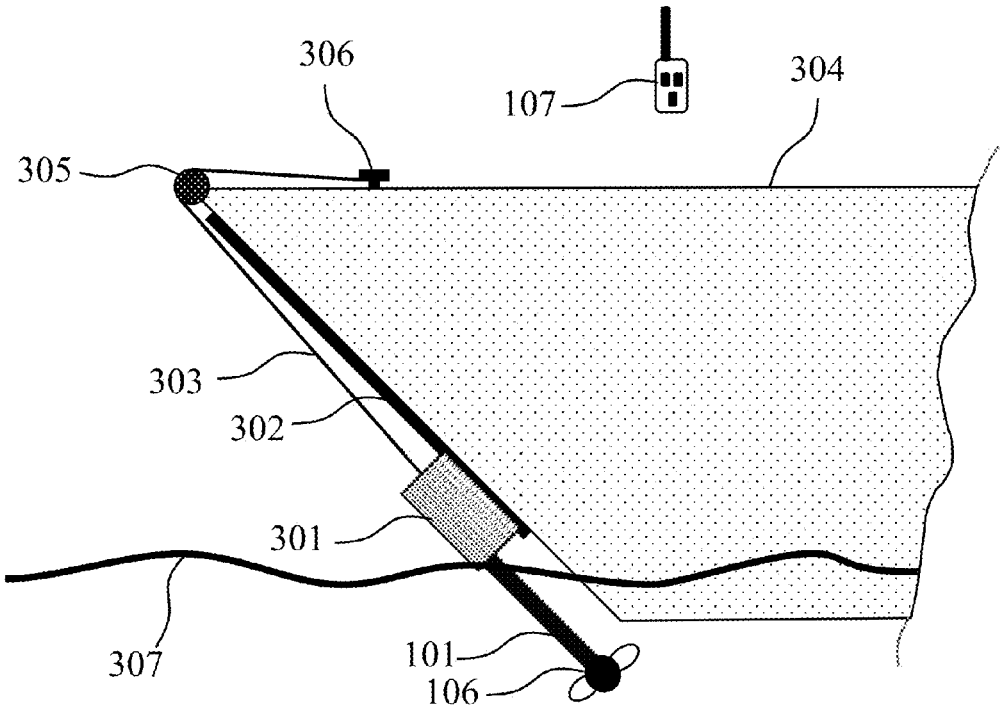
FIGS. 3A-3C show one embodiment of a mounting scheme for attaching a thruster unit to the bow of a boat using a sliding car riding on a rigid track.
Figure 3B:
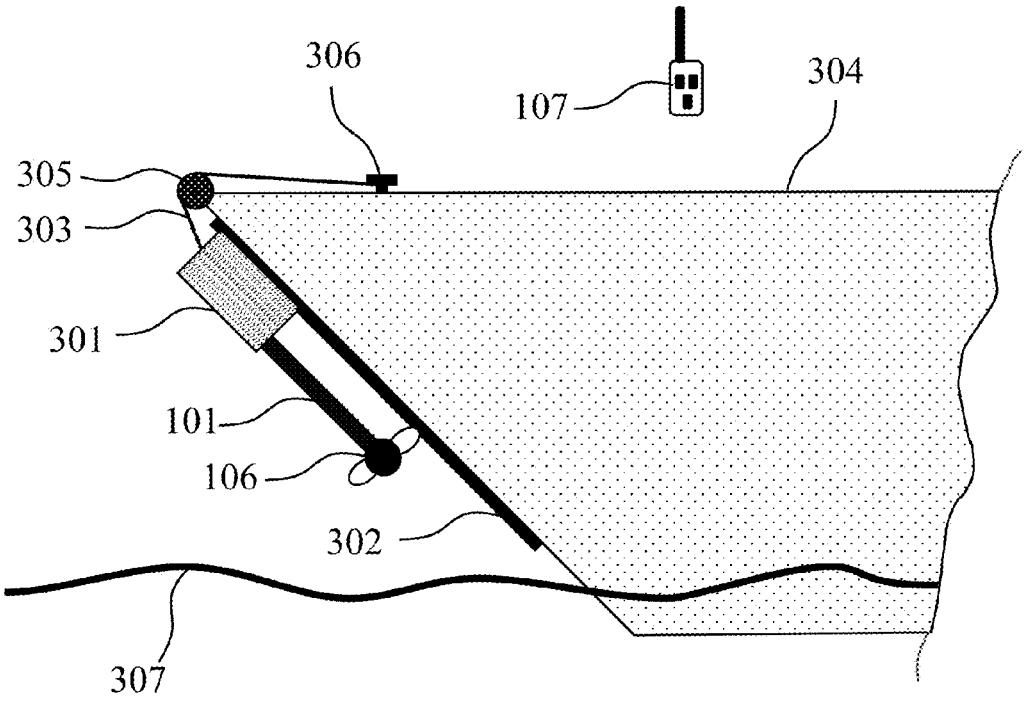
Figure 3C:
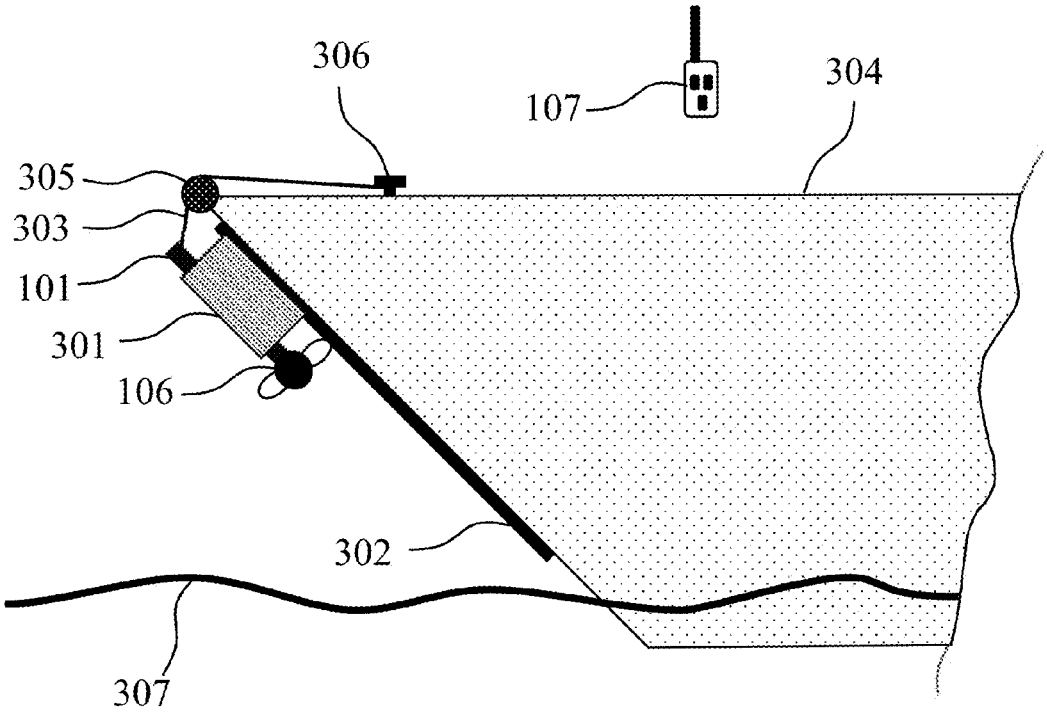

FIGS. 3A-3C show a mounting scheme for attaching thruster unit 101 to the bow of a boat. FIG. 3A shows the thruster unit in the fully deployed position. Thruster unit 101 is engaged with sliding car 301. Sliding car 301 rides along track 302 where the track 302 is bolted to bow 304. Thruster unit 101 and car 301 are lowered along track 302 such that the thruster motor 106 is positioned below water line 307. Tether line 303 is loosened from lashing point 306 to allow thruster unit 101 and car 301 to be lowered. Tether line 303 is attached to either thruster unit 101 or to car 301. To facilitate lowering and raising of thruster unit 101 and car 301, tether line 303 is run through pulley block 305. Radio transmitter 107 is used to command thruster unit 101 to either provide thrust to the left, to the right, or to be off.

FIG. 3B shows thruster unit 101 in a partially retracted position. Tether line 303 is shortened by pulling it through pulley block 305 and then reattaching it to lashing point 306. This causes car 301 to ride up along track 302 bolted to bow 304; raising the position of thruster unit 101 and positioning thruster motor 106 above water line 307. With thruster motor 106 out of the water, radio transmitter 107 has no function and is not used while thruster unit 101 is in this position.

FIG. 3C shows thruster unit 101 in a fully retracted position. In this embodiment tether line 303 is attached to thruster unit 101. Thruster unit 101 is engaged with car 301 such that thruster unit 101 is free to slide along car 301. Shortening tether line 303 by pulling it through pulley block 305 and then reattaching it to lashing point 306 causes thruster unit 101 to slide up relative to car 301 which is already at the top of track 302 bolted to bow 304. This allows motor 106 to be further raised above water line 307. Radio transmitter 107 is not used while thruster unit 101 is in this position.

It should be noted that the end result of raising motor 106 well above the water line could also be achieved, for example, by extending track 302 above the deck of bow 304 or by pivoting thruster unit 101 relative to car 301.

Figure 4:
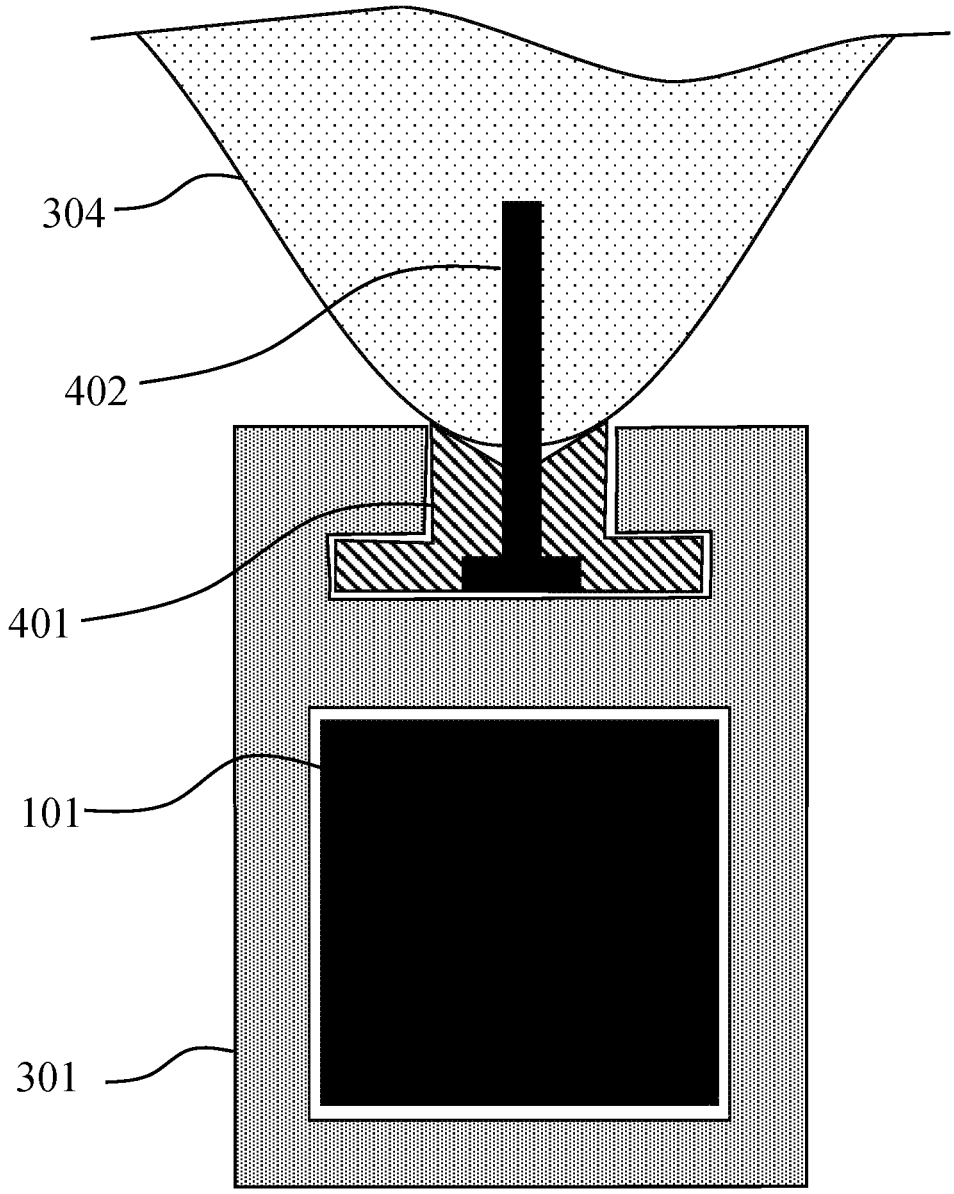
FIG. 4 shows the top view of one embodiment of a thruster unit engaged inside a slider car which in turn is riding on a track mounted to the bow of a boat.

FIG. 4 shows the top view of one embodiment of thruster unit 101 engaged inside slider car 301 which in turn is riding on track 401 mounted to bow 304 using hull attachment fixture 402. In some embodiments, hull attachment fixture 402 can simply be a bolt. Track 401 prevents car 301 from moving or rotating in any direction except laterally along the length of track 401. When car 301 is constrained to be at one position along track 401, car 301 is firmly held fast relative to bow 304 in all directions. Car 301 can be constrained at the bottom of track 301, for example, by using the weight of thruster unit 101 to hold car 301 against a bottom stop on track 301. Car 301 can be constrained at the top of track 301, for example, by having a tether line forcing car 301 against a top stop on track 301.

In the embodiment shown in FIG. 4, thruster unit 101 is engaged inside car 301 such that it is free to slide laterally along the length of car 301. When thruster unit 101 is constrained from sliding along the length of car 301, and car 301 is constrained from sliding along track 401, thruster unit 101 is firmly held fast relative to bow 304 in all directions. Thruster unit 101 can be constrained relative to car 301, for example, using locking pins, tether line tension, or the weight of thruster unit 101 against a stop. Thruster unit 101 can also be permanently attached to car 301 so that the two items are essentially one unit.

Figure 5A:
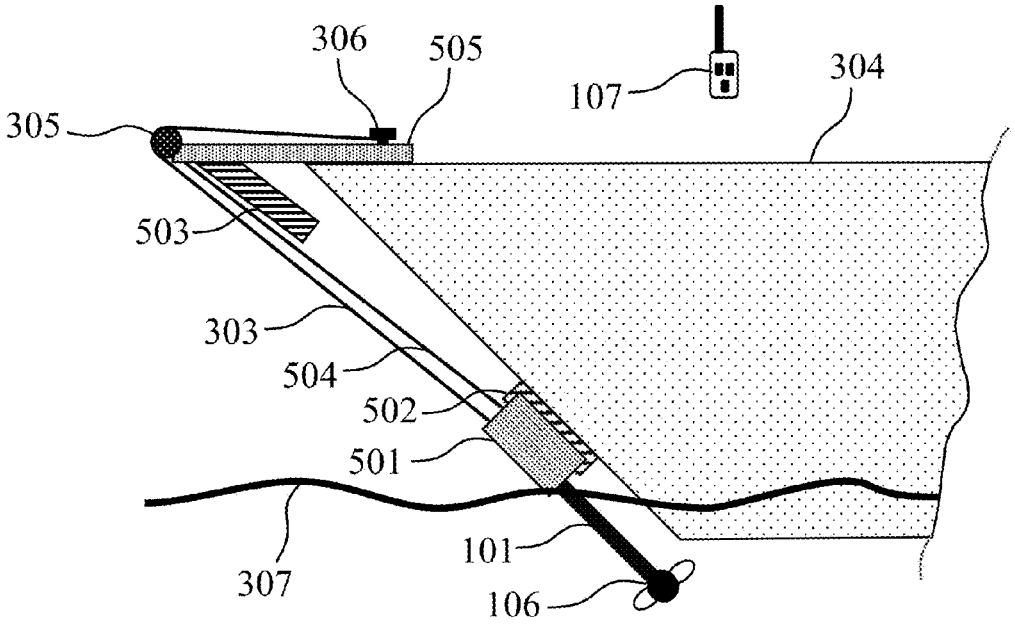
FIGS. 5A-5C show another embodiment of a mounting scheme for attaching a thruster unit to the bow of a boat using a car sliding along a guy line.
Figure 5B:
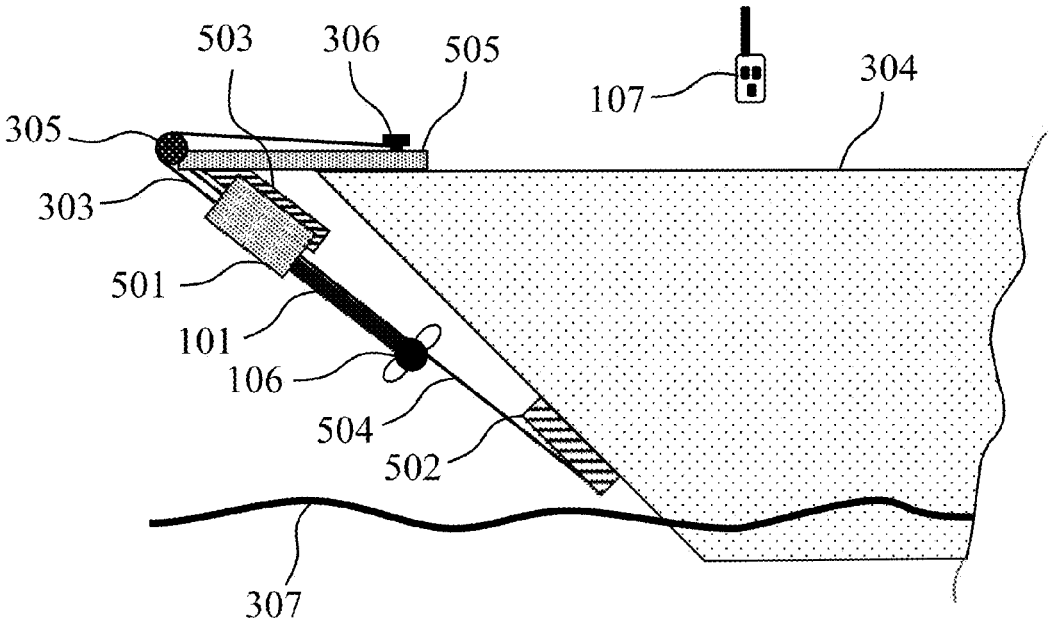
Figure 5C:
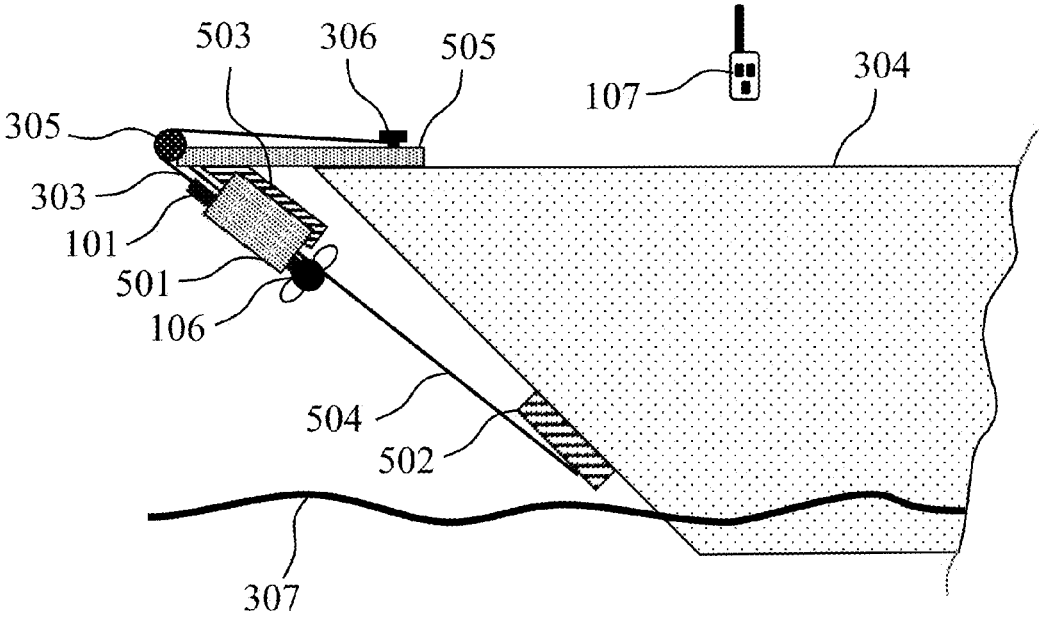

FIGS. 5A-5C show a mounting scheme for attaching thruster unit 101 to the bow of a boat. FIG. 5A shows the thruster unit in the fully deployed position. Thruster unit 101 is engaged with sliding car 501. In one or more embodiments, a guy line 504 is attached to upper hull attachment fixture 503 and to lower hull attachment fixture 502. In this example, upper hull attachment fixture 503 is attached to bow sprit 505 which can be considered as an extension of bow 304. Lower hull attachment fixture 502 is mounted to bow 304 near water line 307. The sliding car 501 rides along guy line 504. Thruster unit 101 and car 501 are lowered along guy line 504 such that the thruster motor 106 is positioned below water line 307. Tether line 303 is loosened from lashing point 306 to allow thruster unit 101 and car 501 to be lowered. Tether line 303 is attached to either thruster unit 101 or to car 501. To facilitate lowering and raising of thruster unit 101 and car 501, tether line 303 is run through pulley block 305. Radio transmitter 107 is used to command thruster unit 101 to either provide thrust to the left, to the right, or to be off.

FIG. 5B shows thruster unit 101 in a partially retracted position. Tether line 303 is shortened by pulling it through pulley block 305 and then reattaching it to lashing point 306. This causes car 501 to ride up along guy line 504 attached to upper hull attachment fixture 503 and to lower hull attachment 502 raising the position of thruster unit 101 and positioning thruster motor 106 above water line 307. Lower hull attachment fixture 502 is mounted to bow 304 near water line 307 and upper hull attachment fixture 503 is attached to bow sprit 505 near the deck of bow 304. With thruster motor 106 out of the water, radio transmitter 107 has no function and is not used while thruster unit 101 is in this position.

FIG. 5C shows thruster unit 101 in a fully retracted position. In this embodiment tether line 303 is attached to thruster unit 101. Thruster unit 101 is engaged with car 501 such that thruster unit 101 is free to slide along car 501. Shortening tether line 303 by pulling it through pulley block 305 and then reattaching it to lashing point 306 causes thruster unit 101 to slide up relative to car 501 which is already at the top of guy line 504 attached to hull attachment fixtures 502 and 503. This allows motor 106 to be further raised above water line 307. Lower hull attachment fixture 502 is mounted to bow 304 near water line 307 and upper hull attachment fixture 503 is attached to bow sprit 505 near the deck of bow 304. Radio transmitter 107 is not used while thruster unit 101 is in this position.

It should be noted that the end result of raising motor 106 well above the water line could also be achieved, for example, by extending guy line 504 above the deck of bow 304 or by pivoting thruster unit 101 relative to car 501. In another embodiment, guy line 504 could be loosened from upper hull attachment 503 to allow thruster unit 101 to be lifted up onto the deck.

It should also be noted that upper hull attachment fixture could be mounted directly to bow 304 rather than bow sprit 505. This example shows it attached to bow sprit 505 to demonstrate that guy line 504 merely needs to be anchored in some way near the top of hull 304. Guy line 504 could, for example, be attached to bow 304 by running it through pulley block 305 and tying it to lashing point 306.

Figure 6:
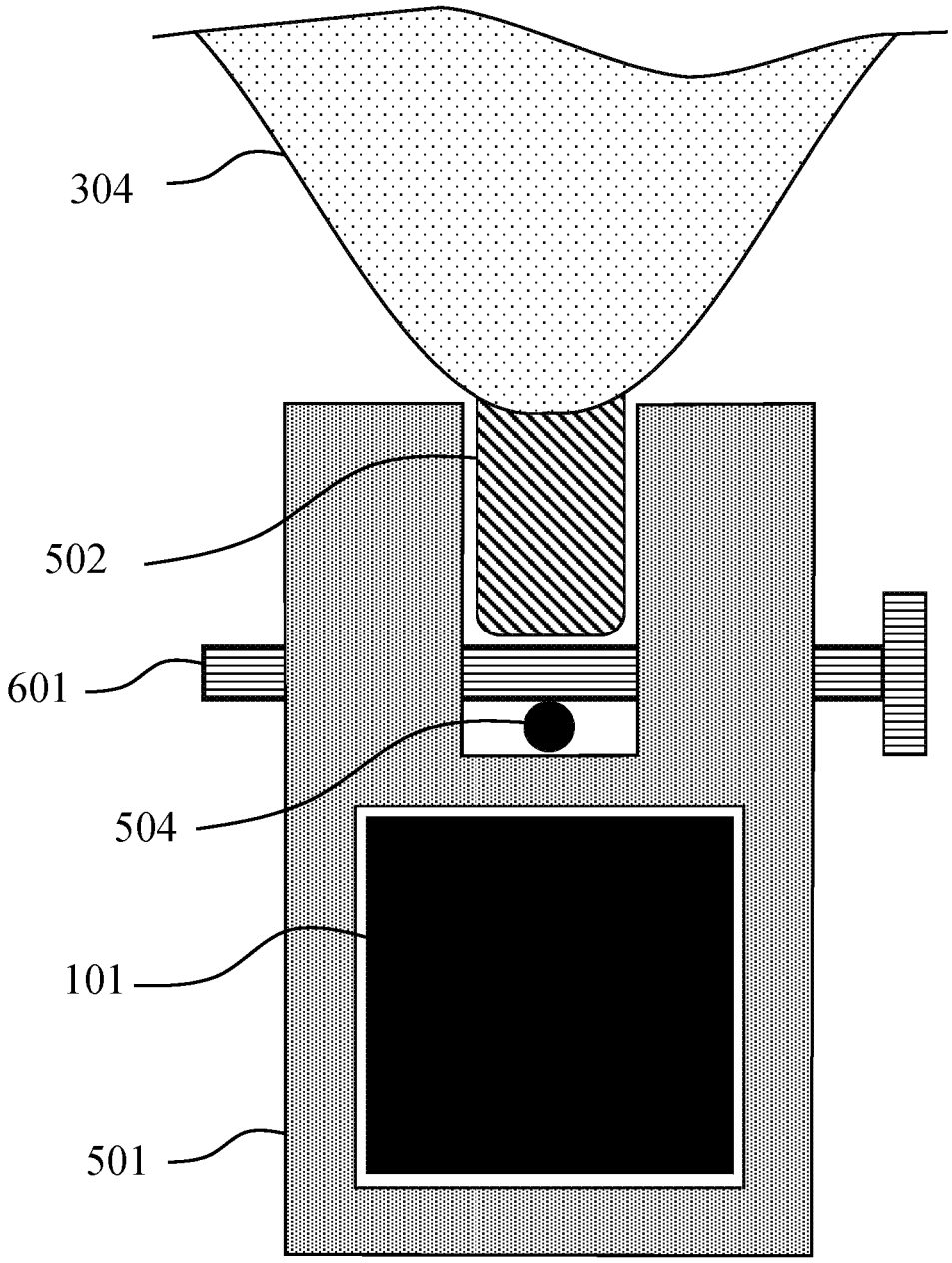
FIG. 6 shows the top view of one embodiment of a thruster unit engaged inside a slider car which in turn is riding on a guy line.

FIG. 6 shows the top view of one embodiment of thruster unit 101 engaged inside slider car 501 which in turn is riding on guy line 504. Car 501 is held to guy line 504 by locking pin 601. Locking pin 601 can be removed to allow car 501 to be freed from guy line 504. This would allow thruster unit 101 to be removed from bow 304.

Guy line 504 is attached to hull attachment fixture 502 (not shown in this view). Hull attachment fixture 502 is mounted to hull 304 thus providing a secure attachment for guy line 504. Hull attachment fixture 502 includes a guide rail feature that engages with the channel in car 501 once car 501 has slid to the bottom of guy line 504. This guide rail feature prevents car 501 from rotating around guy line 504 and from torqueing guy line 504 when thruster unit 101 is thrusting. Thus, the combined mechanical constraints of guy line 504 and hull attachment fixture 502 fully constrain the movement of thruster unit 101 relative to bow 304.

In the embodiment shown in FIG. 6, thruster unit 101 is engaged inside car 501 such that it is free to slide laterally along the length of car 501. When thruster unit 101 is constrained from sliding along the length of car 501, and car 501 is constrained from sliding along guy line 504, thruster unit 101 is firmly held relative to bow 304 in all directions. Thruster unit 101 can be constrained relative to car 501, for example, using locking pins, tether line tension, or the weight of thruster unit 101 against a stop. Thruster unit 101 can also be permanently attached to car 501 so that the two items are essentially one unit. One embodiment of this integrated concept is shown in FIGS. 7 and 8.

Figure 7A:
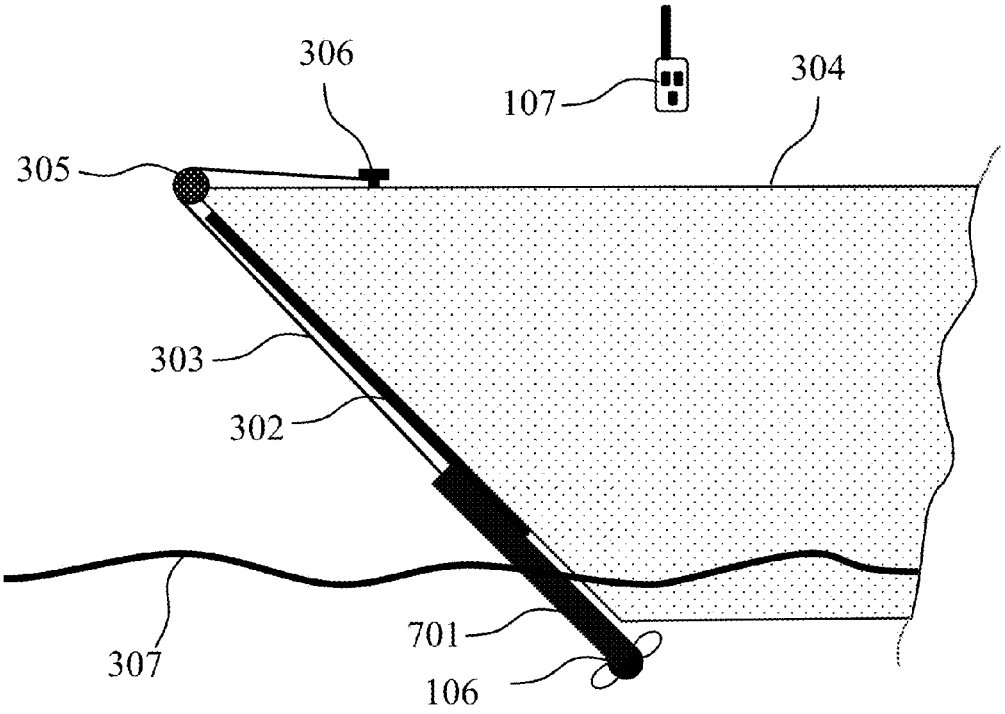
FIGS. 7A-7B show another embodiment of a mounting scheme for attaching a thruster unit to the bow of a boat. This embodiment integrates the sliding car and thruster unit into a single unit. The housing of the thruster unit contains features running the length of the thruster unit that engage with a track allowing it to slide up and down on the track.
Figure 8:
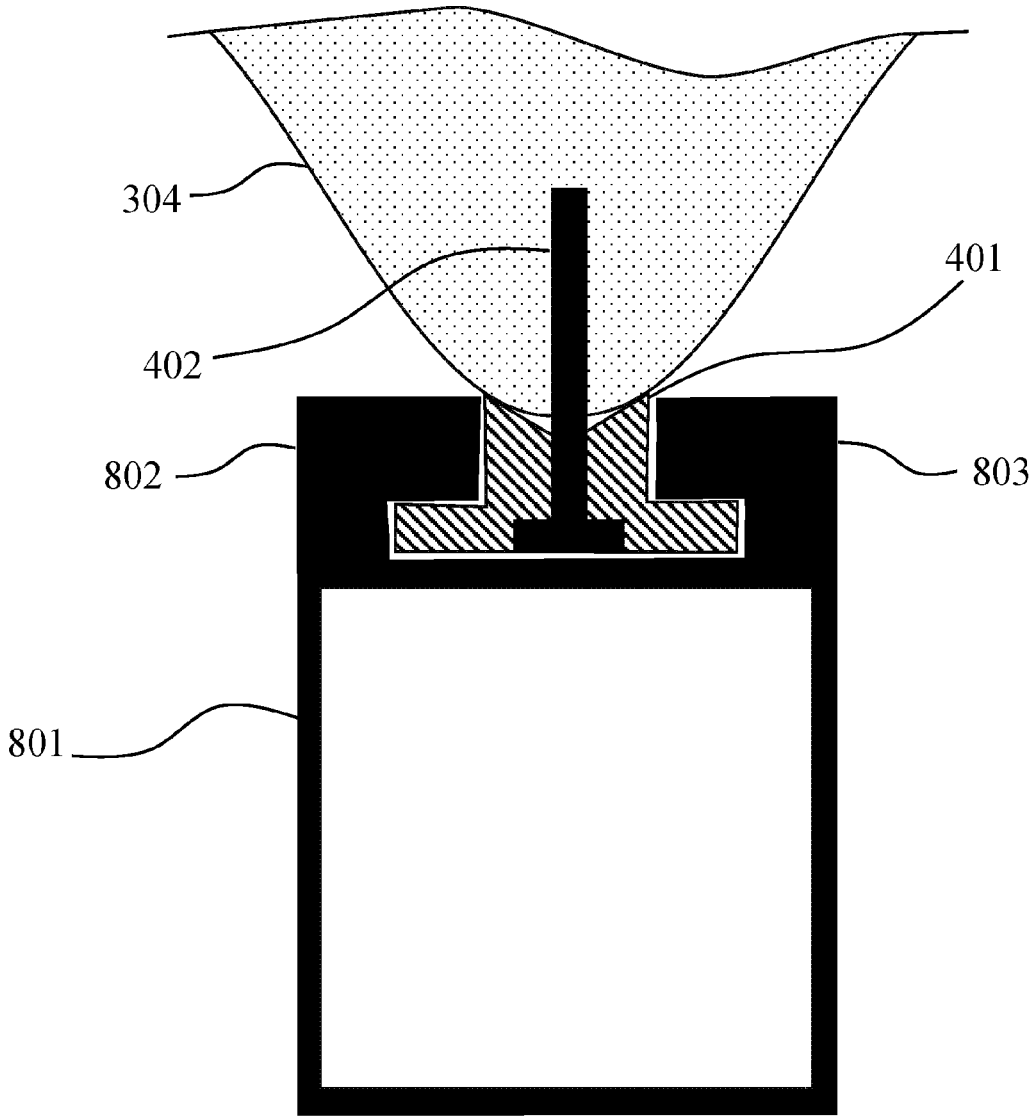
FIG. 8 shows a top view of the thruster unit integrated with the sliding car features that allow it to slide up and down on a t-track without requiring a separate sliding car.

FIG. 7A shows a thruster unit in the fully deployed position. Thruster unit 701 is integrated with sliding car guide features that engage with track 302, eliminating the need for a separate sliding car. These guide features enable the thruster unit 701 to slide along track 302 which is bolted to bow 304. In this example, the features that engage with track 302 run the entire length of thruster unit 701. Thruster unit 701 is lowered along track 302 such that the thruster motor 106 is positioned below water line 307. Tether line 303 is loosened from lashing point 306 to allow thruster unit 701 to be lowered. To facilitate lowering and raising of thruster unit 701, tether line 303 is run through pulley block 305. Radio transmitter 107 is used to command thruster unit 701 to either provide thrust to the left, to the right, or to be off.

Figure 7B:
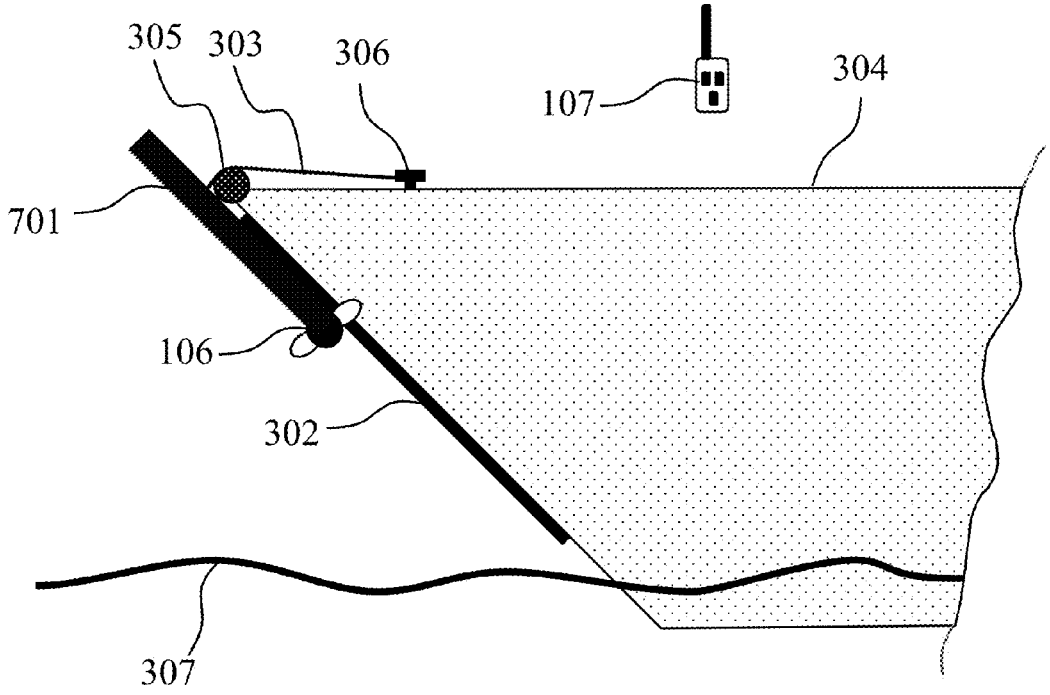

FIG. 7B shows thruster unit 701 in a fully retracted position. Shortening tether line 303 by pulling it through pulley block 305 and then reattaching it to lashing point 306 causes thruster unit 701 to slide up track 302 bolted to bow 304. Since the sliding car guide features engaging thruster unit 701 to track 302 run the entire length of thruster unit 701, a portion of thruster unit 701 can be raised beyond the end of track 302 and still be securely engaged to track 302. This allows motor 106 to be raised further above water line 307. Radio transmitter 107 is not used while thruster unit 701 is in this position.

It should be noted that the end result of raising motor 106 well above the water line could also be achieved, for example, by extending track 302 above the deck of bow 304.

Thruster unit 701 can be removed from the bow of the boat by continuing to raise it off the end of track 302.

FIG. 8 shows the top view of one embodiment of thruster unit housing 801 integrated with sliding car guide features 802 and 803. These guide features are extensions of the thruster unit housing 801. One common manufacturing method is to extrude aluminum or other metal to simultaneously form thruster unit housing 801 and guide features 802 and 803 resulting in a single metal piece. Sliding car guide features 802 and 803 engage with T-track 401 allowing thruster unit housing 801 to ride up and down track 401 mounted to bow 304 using hull attachment fixture 402. In some embodiments, hull attachment fixture 402 can simply be a bolt. Track 401 prevents thruster unit housing 801 from moving or rotating in any direction except laterally along the length of track 401. Thruster unit housing 801 can be lowered partially past the bottom end of track 401 when deployed and raised partially above the end of track 401 when retracted. This is possible because the guide features 802 and 803 run the entire length of thruster unit housing and only a portion of the guide features need to be engaged with track 401 at any one time.

In FIGS. 3 through 8 the thruster unit is shown mounted to the bow of a boat. These same, or similar, mounting schemes can be employed to mount the thruster unit to the stern of a boat.

In one or more embodiments, the bow and stern thrusters further include a means for guiding the thruster unit housing 201 up and down a hull of the boat. In one or more embodiments, the means for guiding the thruster unit housing 201 includes a sliding car 301, 501 coupled with the thruster unit housing 201, the sliding car 301, 501 slideably coupled with a guide device mounted on the hull.

The embodiments solves the problems of conventional bow and stern thrusters by eliminating the need for any electrical power or signal connections to the boat, and by providing for above-the-waterline external attachment of a fully integrated thruster unit. These features allow the thruster motor to be deployed below the waterline during use and subsequently retracted while under way. This ability to retract the thruster motor eliminates drag and prevents corrosion and seaweed from accumulating on the propellers or other propulsion mechanisms. The ability to mount the fully integrated thruster unit externally above the water line eliminates the need for the conventional thruster tunnel and subsequent hull modifications. It also eliminates the need for hauling the boat out of the water. Together, these features greatly reduce the cost of installation and ownership.

The thruster unit described here contains the batteries, the radio receiver, the control logic, the electrical power drivers and the thruster motor needed to make a stand-alone bow or stern thruster. The thruster unit rides up and down along a guide device that has one end mounted to the hull of the boat near the water line and the other end mounted to the boat up near the deck. By pulling on a tether line attached to the thruster unit the thruster unit can be hauled up along the guide device so that the thruster motor is out of the water. When the thruster is again needed, the thruster unit can be lowered along the guide device by letting out the tether line.

The operator commands the thruster to either thrust left, thrust right, or to be off by manipulating the buttons of a radio transmitter. The transmitter communicates the operator's commands to the radio receiver in the thruster unit.

The radio link provides the command and control channel so that no control wires through the hull are required. The integrated batteries provide the thruster motor electrical power requirements so that no power wires through the hull are required.

There are many variants for mounting the thruster unit to the outside of the hull. An addition advantage is that all of the thruster functions are integrated into a single thruster unit freeing up the unit to be mounted exterior to the boat in a manner that provides for secure attachment while deployed and for removal from the water when not deployed.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope should, therefore, be determined with reference to the appended claims, along with the full scope of equivalents to which such claims are entitled.

What is claimed is:

1. A thruster apparatus for use with a boat, the thruster apparatus comprising:

one or more electric motors operatively coupled with one or more propulsion devices, the one or more electric motors configured to drive the one or more propulsion devices;

at least one power source coupled with the one or more electric motors, the at least one power source configured to provide power for the one or more electric motors;

an electrical controller configured to receive a wireless signal, the electrical controller configured to control power to the one or more electric motors based on the wireless signal;

a thruster unit housing containing the one or more electric motors with the one or more propulsion devices, the electrical controller, and the at least one power source;

a sliding car coupled with the thruster unit housing;

one or more hull attachment fixtures mounted to a hull of the boat with at least one hull attachment fixture mounted near a water line; and a guide device coupled with one or more hull attachment fixtures, the guide device configured to guide the sliding car up and down.

2. The thruster apparatus of claim 1, wherein the guide device is a track.

3. The thruster apparatus of claim 2, wherein the thruster unit housing and sliding car can be removed from the track once the thruster unit housing is raised to a deck allowing for removal of the thruster unit housing from the hull of the boat.

4. The thruster apparatus of claim 1, wherein the guide device is a guy line and at least one of the one or more hull attachment fixtures has a guide rail that engages with the sliding car as the sliding car slides down along the guy line.

5. The thruster apparatus of claim 4, wherein the thruster unit housing and sliding car are removably coupled with the guy line.

6. The thruster apparatus of claim 1, wherein the thruster unit housing and the sliding car are coupled together into a single assembly.

7. The thruster apparatus of claim 1, wherein the at least one power source includes one or more batteries.

8. A thruster apparatus for use with a boat, the thruster apparatus comprising:

one or more electric motors operatively coupled with one or more propulsion devices, an at least one power source configured to drive the one or more propulsion devices;

at least one power source coupled with the one or more electric motors, the at least one power source configured to provide power for one or more electric motors;

a signal transmitter configured to send a wireless signal;

an electrical controller configured to receive the wireless signal, the electrical controller configured to control power to the one or more electric motors based on the wireless signal;

a thruster unit housing containing the one or more electric motors with the one or more propulsion devices, the electrical controller, and the at least one power source; and means for guiding the thruster unit housing up and down a hull of the boat, wherein the means for guiding the thruster unit housing includes a sliding car coupled with the thruster unit housing, the sliding car slideably coupled with a guide device mounted on the hull.

9. The apparatus of claim 8, wherein the guide device is a track.

10. The thruster apparatus of claim 8, wherein the thruster unit housing and sliding car can be removed from the track once the thruster unit housing is raised to a deck allowing for removal of the thruster unit from the hull of the boat.

11. The thruster apparatus of claim 8, wherein the guide device is a guy line and at least one of the one or more hull attachment fixtures has a guide rail that engages with the sliding car as it slides down along the guy line.

12. The thruster apparatus of claim 11, wherein the thruster unit housing and sliding car are removably coupled with the guy line.

13. The thruster apparatus of claim 8, wherein the thruster unit housing and the sliding car are coupled together into a single assembly.

14. The thruster apparatus of claim 8, wherein the at least one power source includes one or more batteries.

15. A method for using a thruster apparatus with a boat, the method comprising:

providing power from at least one power source to one or more electric motors;

sending a wireless signal from a transmitter to an electrical controller that receives the wireless signal and controls power to the one or more electric motors based on the wireless signal;

driving one or more propulsion devices with the one or more electric motors, where a thruster unit housing contains the one or more motors, the electrical controller, and the at least one power source; and sliding a sliding car along a guide device, where the sliding car is coupled with the thruster unit housing, and the guide device is coupled along a hull of the boat with one or more hull attachment fixtures.

16. The method of claim 15, wherein sliding the sliding car on the guide device includes sliding the sliding car on a track.

17. The method of claim 16, further comprising removing the thruster unit housing and sliding car mechanism from the track once the thruster unit housing is raised to the deck.

18. The method of claim 15, wherein the thruster unit housing and sliding car can be removed from a guy line once raised to the deck allowing for the removal of the thruster unit from the hull of the boat.

* * * * *